US005775874A

United States Patent [19]

Boite et al.

[11] Patent Number: 5,775,874

[45] Date of Patent: Jul. 7, 1998

[54] DEVICE FOR JOINING CIRCULAR DISTRIBUTOR SEGMENTS TO A TURBINE ENGINE CASING

[75] Inventors: Sylvain Boite; Jean-Baptiste Arilla, both of Savigny le Temple, France

[73] Assignee: Societe Nationale d'Etude et de Construction de Moteurs d'Aviation "Snecma", Paris, France

[21] Appl. No.: 760,872

[22] Filed: Dec. 9, 1996

[30] Foreign Application Priority Data

Jan. 11, 1996 [FR] France ..... 96 00241

[51] Int. Cl.[6] ..... F04D 29/44

[52] U.S. Cl. ..... 415/209.3; 415/209.1

[58] Field of Search ..... 415/209.1, 209.2, 415/209.3

[56] References Cited

U.S. PATENT DOCUMENTS 5,080,557 1/1992 Berger .
5,201,846 4/1993 Sweeney .

FOREIGN PATENT DOCUMENTS 0 608 080 7/1994 European Pat. Off. .

*Primary Examiner*—John T. Kwon
*Attorney, Agent, or Firm*—Oblon, Spivak, McClelland, Maier & Neustadt, P.C.

[57] ABSTRACT

Device for joining turbine engine distributor segments (22) to a casing (3). The pins (13) for stopping the rotation of the segments (22), engaged in notches (26) of the latter, are separated from a casing-abutment flange (23) by a continuous partition (27), which prevents any air leak. (FIG. 2)

2 Claims, 3 Drawing Sheets

Figure 1:
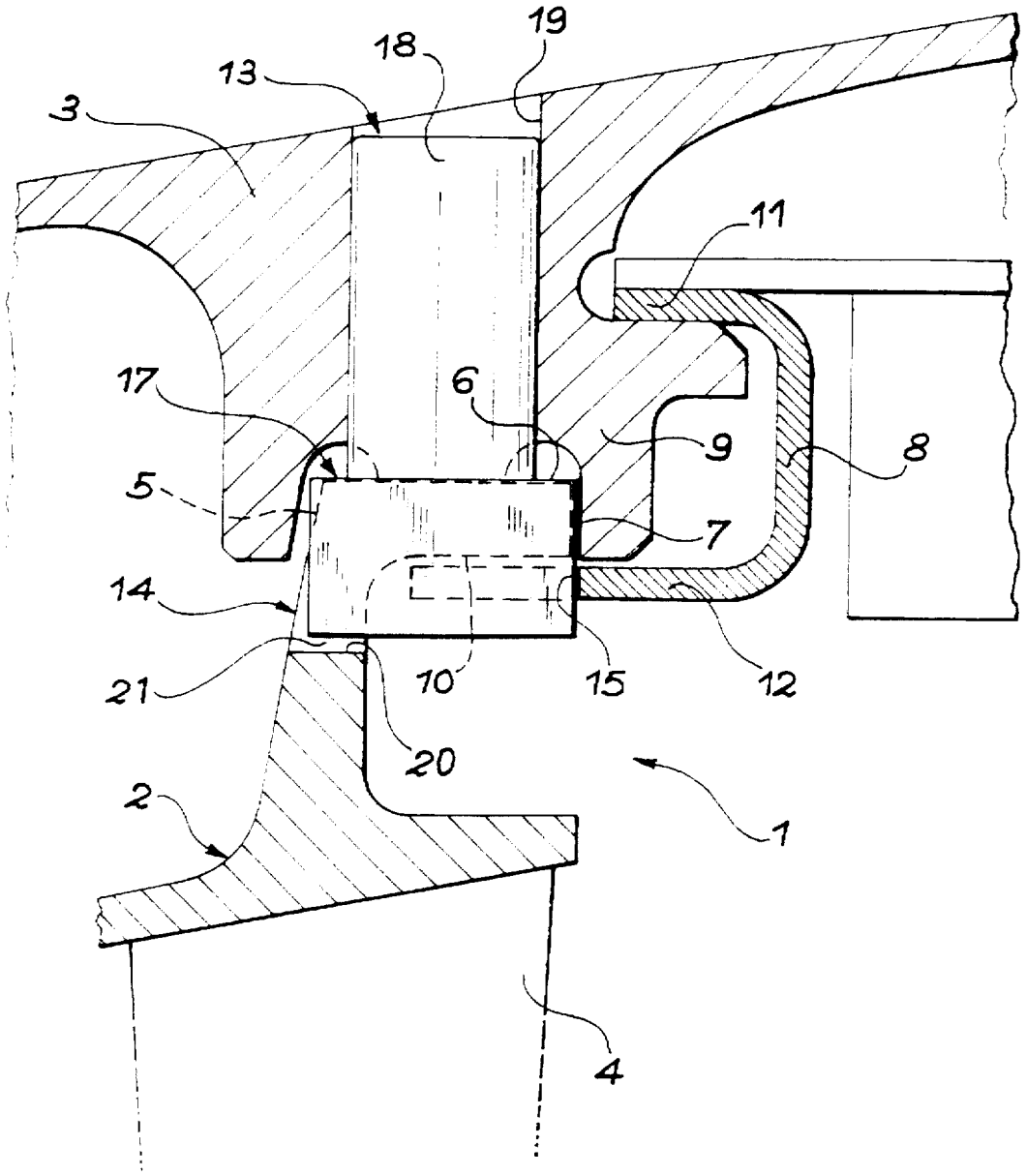
FIG. 1 PRIOR ART

FIG. 3
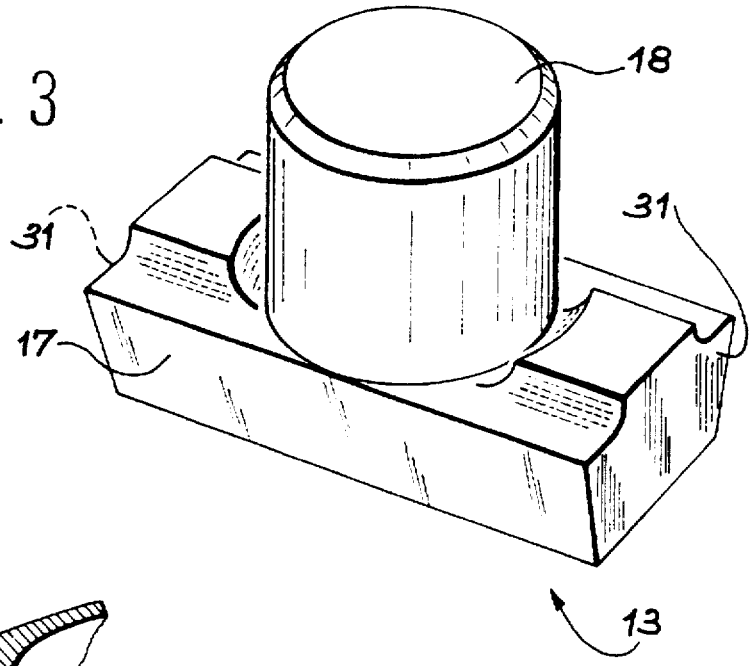
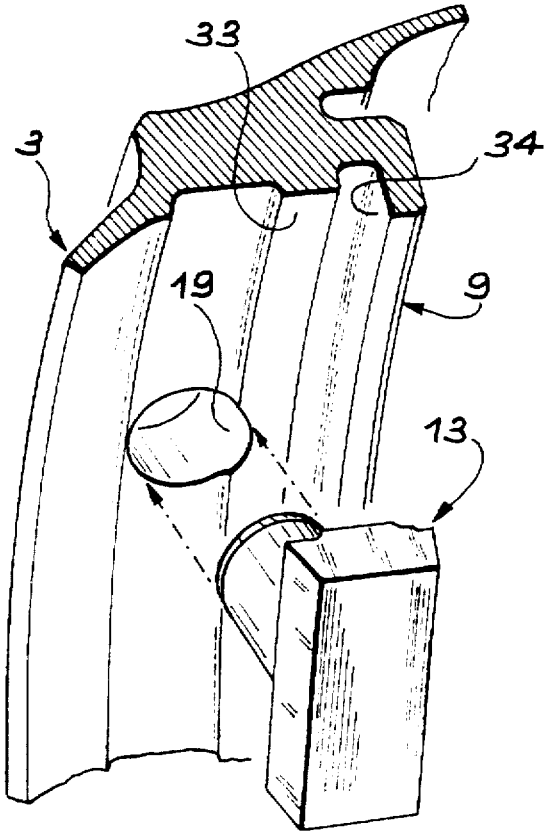
FIG. 4
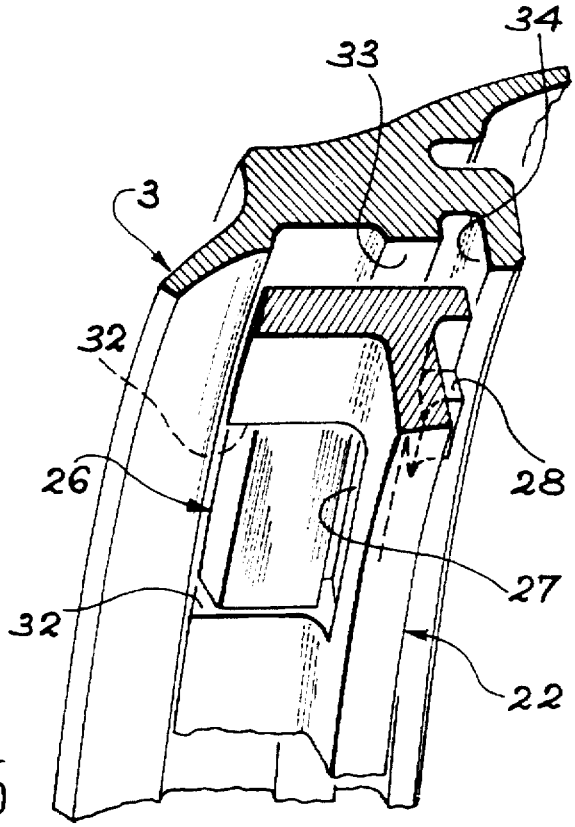
FIG. 5

DEVICE FOR JOINING CIRCULAR DISTRIBUTOR SEGMENTS TO A TURBINE ENGINE CASING

DESCRIPTION

The invention relates to a device for joining distributor segments to a turbine engine casing.

A distributor is a bladed annular part fixed circumferentially to the stator. In the known arrangement according to FIG. 1 and more particularly illustrated by US-A-5 201 846, the distributor I is formed by segments 2 arranged in circular manner and carrying blades 4, which are not rough-machined and which are held on the casing 3 by external flanges 5, which bear on corresponding surfaces of the casing 3 by an external face 6 and a rear face 7, 15 which are contiguous and at right angles. Ring sectors 8 engage beneath an internal face 10 of the flanges 5 and consequently prevent the segments 2 from coming apart and dropping into the casing 3. More specifically, the clip-like sectors 8 have two circular, concentric lips 11 and 12 between the bottom of which is held a ledge 9 of the casing 3. The end of the inner lip 12 is more specifically the portion which is slid beneath the flanges 5.

Thus, the arrangement has pins 13, whose main function is to retain the segments 2 and also keep the sectors 8 with respect to rotary sliding movements about the machine axis. To this end, these parts have notches, respectively 14 and 15 on a portion of their angular extension and a head 17 of the pins 13 is engaged therein. A rod 18 of the pins 13, retained in a respective bore 19 of the casing 3 by force fitting, keeps the pins 13 in place. However, it is necessary to leave clearances 21 between the bottoms 20 of the notches 14 and the heads 17, by which the air circulating in the distributor can infiltrate in order to leak alongside the normal flow and lower the performance characteristics of the turbine engine.

Thus, the object of the invention is to correct this defective structure and it is possible to arrive at this by means of a device, which is characterized in that the notches act outside the support flanges and separated therefrom by a continuous wall along segments and contiguous with the casing. Thus, the notches allocated to the reception of the pins and the rotation stoppage of the segments remains separate from the locations responsible for the sealing action and do not encroach thereon.

Figure 2:
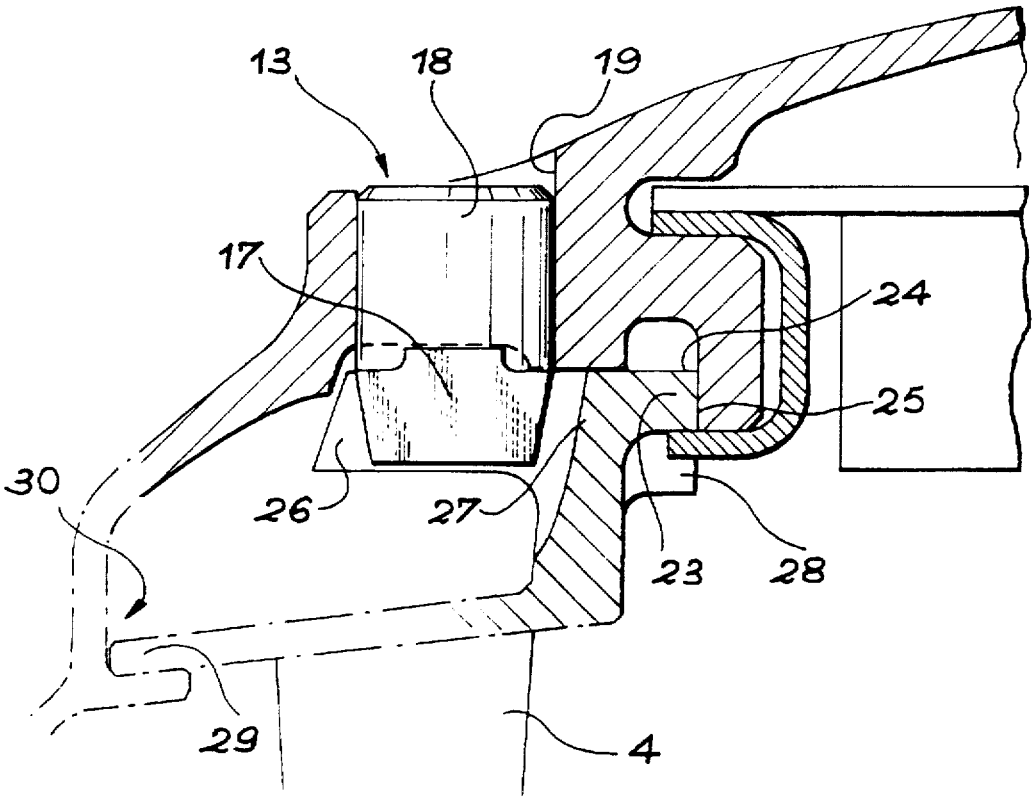
Figure 2:
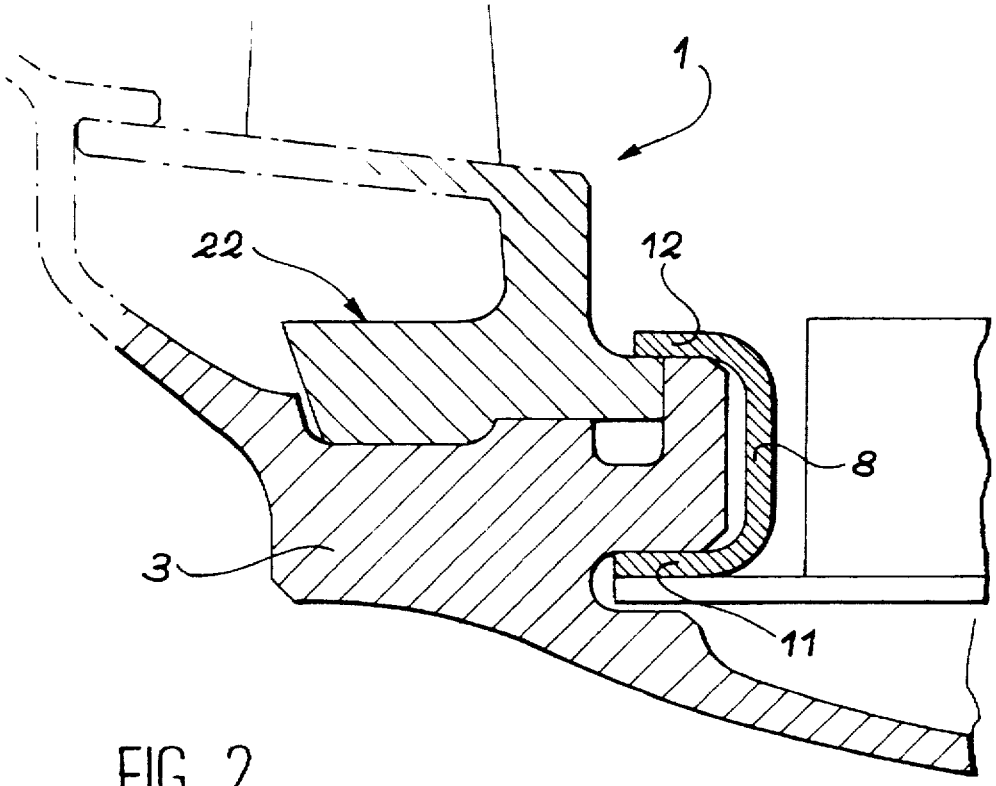

The invention will now be described relative to the attached drawings, in an illustrative and non-limitative manner. FIG. 1, already described, illustrates the prior art. FIG. 2 is a general view of the arrangement according to the invention. FIGS. 3, 4 and 5 are perspective views respectively illustrating one of the rotation stopping pins, its arrangement in the casing and the way in which it retains the segments.

The novel FIGS. 2 to 5 have references already used in connection with FIG. 1, because they illustrate similar or identical elements, so that no supplementary description is provided here. The modifications apply to the structure of the circular arc distributor segments 22.

They are still provided with a peripheral flange 23 bearing by external 24 and rear 25 faces on the corresponding faces of the casing 3 and the ring sectors 8 secure against a radial movement, but in this case the notches 26 in which the heads 17 of the pins 13 are inserted are not hollowed out in the flanges 23, but are opposite thereto and more specifically are separated therefrom by a wall 27 extending continuously over the entire angular extension of the segments 22 touching the casing 3. Thus, the pins 13 are no longer responsible, by the notches required by them, for air leak generating clearances and the setting of the faces 24 and 25 on the casing 3 is sufficiently tight to prevent such leaks.

Advantageously, projections 28 are provided beneath the flanges 25 and extend over an angular extension fragment thereof in order to retain the ring sectors 18 on penetrating their notches. The function of these projections was devolved to the pins 13 in the prior art construction. The abutment of the rear face 25 of the flanges 23 on the casing 3 is obtained through the engagement of hooks 29 of segments 22, in the form of forwardly projecting tablets, in recesses 30 of the casing 3, at the bottom of which they bear.

FIG. 3 illustrates a pin 13, its cylindrical rod 18 and its parallelepipedic head 17 having planar lateral faces 31 positioned in front of the planar faces 32 (visible in FIG. 5), where the notches 26 terminate.

FIG. 4 illustrates a pin 13 at the time of engagement in a bore 19, as well as a fragment of the casing 3 and the abutment surfaces 33, 34 of the distributor segments 22.

FIG. 5 shows the pin 13 and a distributor fragment 2 installed on said casing fragment 3 and one of the projections 28 is also visible.

We claim:

1. Device for joining circular distributor segments to a turbine engine casing, comprising:

pins for stopping the rotation of the segments, fixed to the casing and penetrating notches of the segments, ring sectors engaged on the casing and retaining a flange of the segments against the casing, and a continuous wall along the segments and touching engaging the casing and separating the flange from the notches.

2. Device for joining segments according to claim 1, wherein the segments are provided with projections extending beneath the flanges and penetrating notches of the ring sectors in order to retain the ring sectors in rotation.

* * * * *